US007385876B2

(12) United States Patent
Ihara et al.

(10) Patent No.: US 7,385,876 B2
(45) Date of Patent: Jun. 10, 2008

(54) RADIO-CONTROLLED TIMEPIECE, ELECTRONIC DEVICE, TIME CORRECTING METHOD AND COMPUTER PRODUCT

(75) Inventors: Takashi Ihara, Tokyo (JP); Akinari Takada, Tokyo (JP); Masaaki Namekawa, Tokyo (JP); Masami Fukuda, Tokyo (JP); Minoru Kobayashi, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 445 days.

(21) Appl. No.: 10/861,389

(22) Filed: Jun. 7, 2004

(65) Prior Publication Data

US 2005/0185514 A1 Aug. 25, 2005

(30) Foreign Application Priority Data

Jun. 9, 2003 (JP) ..... 2003-163645

(51) Int. Cl.
*G04B 19/22* (2006.01)
*G04C 11/02* (2006.01)

(52) U.S. Cl. ..... 368/21; 368/47

(58) Field of Classification Search ..... 368/10, 368/46, 47, 21; 455/13.2, 500, 502
See application file for complete search history.

(56) References Cited

U.S. PATENT DOCUMENTS

| | | | | |
|---|---|---|---|---|
| 3,675,410 | A * | 7/1972 | Blackwell | 368/61 |
| 6,269,055 | B1 * | 7/2001 | Pikula et al. | 368/47 |
| 6,563,765 | B1 * | 5/2003 | Ishigaki | 368/47 |
| 6,873,573 | B2 * | 3/2005 | Pikula et al. | 368/10 |
| 6,967,901 | B2 * | 11/2005 | Shimizu | 368/47 |
| 7,012,856 | B2 * | 3/2006 | Kibiloski et al. | 368/47 |
| 2005/0094495 | A1 * | 5/2005 | Takada et al. | 368/47 |

* cited by examiner

*Primary Examiner*—P. Austin Bradley
*Assistant Examiner*—Jeanne-Marguerite Goodwin
(74) *Attorney, Agent, or Firm*—Foley & Lardner LLP

(57) ABSTRACT

A radio-controlled timepiece includes a regional-information storage unit that stores information on a target time region, a receiving circuit that receives a standard frequency that contains UTC time information, and that outputs a received signal, a regional-time calculating unit that calculates a current time of the target time region based on the information on the target time region and the received signal, a display unit that displays the current time calculated, a display-time correcting unit that corrects the current time to be displayed in DST or in standard time in timing determined based on the current time when information on a DST switching day is included in the received signal.

28 Claims, 13 Drawing Sheets

FIG.2

| COUNTRY (REGION) NAME | | TIME DIFFERENCE |
|---|---|---|
| USA | FIRST REGION NY | -5 |
| | SECOND REGION CHI | -6 |
| | THIRD REGION COL | -7 |
| | FOURTH REGION LOS | -8 |
| DE | | +1 |
| GB | | 0 |
| JP | | +9 |
| CA | | |

FIG.3

| UTC | FIRST REGION (NY) | SECOND REGION (CHI) | THIRD REGION (COL) | FOURTH REGION (LOS) |
|---|---|---|---|---|
| 0:00 | PREVIOUS DAY 19:00 | PREVIOUS DAY 18:00 | PREVIOUS DAY 17:00 | PREVIOUS DAY 16:00 |
| 1:00 | PREVIOUS DAY 20:00 | PREVIOUS DAY 19:00 | PREVIOUS DAY 18:00 | PREVIOUS DAY 17:00 |
| 2:00 | PREVIOUS DAY 21:00 | PREVIOUS DAY 20:00 | PREVIOUS DAY 19:00 | PREVIOUS DAY 18:00 |
| 3:00 | PREVIOUS DAY 22:00 | PREVIOUS DAY 21:00 | PREVIOUS DAY 20:00 | PREVIOUS DAY 19:00 |
| 4:00 | PREVIOUS DAY 23:00 | PREVIOUS DAY 22:00 | PREVIOUS DAY 21:00 | PREVIOUS DAY 20:00 |
| 5:00 | 0:00 | PREVIOUS DAY 23:00 | PREVIOUS DAY 22:00 | PREVIOUS DAY 21:00 |
| 6:00 | 1:00 | 0:00 | PREVIOUS DAY 23:00 | PREVIOUS DAY 22:00 |
| 7:00 | 2:00 | 1:00 | 0:00 | PREVIOUS DAY 23:00 |
| 8:00 | 3:00 | 2:00 | 1:00 | 0:00 |
| 9:00 | 4:00 | 3:00 | 2:00 | 1:00 |
| 10:00 | 5:00 | 4:00 | 3:00 | 2:00 |
| 11:00 | 6:00 | 5:00 | 4:00 | 3:00 |
| 12:00 | 7:00 | 6:00 | 5:00 | 4:00 |
| 13:00 | 8:00 | 7:00 | 6:00 | 5:00 |
| 14:00 | 9:00 | 8:00 | 7:00 | 6:00 |
| 15:00 | 10:00 | 9:00 | 8:00 | 7:00 |
| 16:00 | 11:00 | 10:00 | 9:00 | 8:00 |
| 17:00 | 12:00 | 11:00 | 10:00 | 9:00 |
| 18:00 | 13:00 | 12:00 | 11:00 | 10:00 |
| 19:00 | 14:00 | 13:00 | 12:00 | 11:00 |
| 20:00 | 15:00 | 14:00 | 13:00 | 12:00 |
| 21:00 | 16:00 | 15:00 | 14:00 | 13:00 |
| 22:00 | 17:00 | 16:00 | 15:00 | 14:00 |
| 23:00 | 18:00 | 17:00 | 16:00 | 15:00 |

FIG.4

| UTC | FIRST REGION (NY) | SECOND REGION (CHI) | THIRD REGION (COL) | FOURTH REGION (LOS) |
|---|---|---|---|---|
| 0:00 | PREVIOUS DAY 20:00 | PREVIOUS DAY 19:00 | PREVIOUS DAY 18:00 | PREVIOUS DAY 17:00 |
| 1:00 | PREVIOUS DAY 21:00 | PREVIOUS DAY 20:00 | PREVIOUS DAY 19:00 | PREVIOUS DAY 18:00 |
| 2:00 | PREVIOUS DAY 22:00 | PREVIOUS DAY 21:00 | PREVIOUS DAY 20:00 | PREVIOUS DAY 19:00 |
| 3:00 | PREVIOUS DAY 23:00 | PREVIOUS DAY 22:00 | PREVIOUS DAY 21:00 | PREVIOUS DAY 20:00 |
| 4:00 | 0:00 | PREVIOUS DAY 23:00 | PREVIOUS DAY 22:00 | PREVIOUS DAY 21:00 |
| 5:00 | 1:00 | 0:00 | PREVIOUS DAY 23:00 | PREVIOUS DAY 22:00 |
| 6:00 | 2:00 | 1:00 | 0:00 | PREVIOUS DAY 23:00 |
| 7:00 | 3:00 | 2:00 | 1:00 | 0:00 |
| 8:00 | 4:00 | 3:00 | 2:00 | 1:00 |
| 9:00 | 5:00 | 4:00 | 3:00 | 2:00 |
| 10:00 | 6:00 | 5:00 | 4:00 | 3:00 |
| 11:00 | 7:00 | 6:00 | 5:00 | 4:00 |
| 12:00 | 8:00 | 7:00 | 6:00 | 5:00 |
| 13:00 | 9:00 | 8:00 | 7:00 | 6:00 |
| 14:00 | 10:00 | 9:00 | 8:00 | 7:00 |
| 15:00 | 11:00 | 10:00 | 9:00 | 8:00 |
| 16:00 | 12:00 | 11:00 | 10:00 | 9:00 |
| 17:00 | 13:00 | 12:00 | 11:00 | 10:00 |
| 18:00 | 14:00 | 13:00 | 12:00 | 11:00 |
| 19:00 | 15:00 | 14:00 | 13:00 | 12:00 |
| 20:00 | 16:00 | 15:00 | 14:00 | 13:00 |
| 21:00 | 17:00 | 16:00 | 15:00 | 14:00 |
| 22:00 | 18:00 | 17:00 | 16:00 | 15:00 |
| 23:00 | 19:00 | 18:00 | 17:00 | 16:00 |

501 502

| Z1 | Z2 | MEANING |
|---|---|---|
| 0 | 0 | DST |
| 1 | 0 | DST-ST SWITCHING DAY |
| 1 | 1 | ST |
| 0 | 1 | ST-DST SWITCHING DAY |

RADIO-CONTROLLED TIMEPIECE, ELECTRONIC DEVICE, TIME CORRECTING METHOD AND COMPUTER PRODUCT

BACKGROUND OF THE INVENTION

1) Field of the Invention

The present invention relates to a radio-controlled timepiece that automatically performs the Daylight Saving Time (DST) to standard time (ST), or vice versa, adjustment.

2) Description of the Related Art

In the countries such as the United States, Japan, Germany, and the United Kingdom, time information is transmitted on a carrier wave of a long-wave standard-frequency (hereinafter, "standard frequency"), i.e. a frequency of several tens of kilohertzs. The radio-controlled timepieces that receive the standard frequency and adjust the time have nowadays become common.

The radio-controlled timepiece receives the standard frequency at predetermined time intervals, and clocks time based on a standard signal until the reception of the standard frequency is performed next time. An internal oscillator circuit and an internal frequency divider circuit generates the standard signal from the standard frequency. The standard frequency includes information on a current time, DST, and leap year, so that the radio-controlled timepiece can display the exact current time, date, and day of the week only from the information included in the standard frequency.

However, some typical problems occur when using the radio-controlled timepieces in the United States. Because in the United States the standard frequency does not include information about when to switch to DST or when to switch to ST, there are four time regions, and the standard frequency includes information about Coordinated Universal Time (UTC), it is not possible to adjust to an appropriate time.

Furthermore, in the United States, when to switch to DST or to ST becomes clear only on the UTC day (i.e., UTC 0 o'clock to 24 o'clock) of performing the switching, sometimes a correct timing of the switching can not be obtained depending on when the standard frequency is received. Especially when UTC is still some time on the previous day in comparison with the local time in each time region as shown in FIGS. 3 and 4, then the switching is performed erroneously.

SUMMARY OF THE INVENTION

It is an object of the present invention to solve at least the problems in the conventional technology.

A radio-controlled timepiece according to an aspect of the present invention includes a regional-information storage unit that stores information relating to a target time region; a standard-frequency receiving unit that receives a standard frequency signal that includes UTC information; a time calculating unit that calculates current time in the target time region based on the information stored in the regional-information storage unit and information in the standard frequency signal received by the standard-frequency receiving unit; a time display unit that displays the current time; and a display-time correcting unit that corrects at a predetermined timing the current time to be displayed in DST at the time display unit when information on a switching day to DST is included in the information in the standard frequency signal received by the standard-frequency receiving unit.

A radio-controlled timepiece according to another aspect of the present invention includes a regional-information storage unit that stores information relating to a target time region; a standard-frequency receiving unit that receives a standard frequency signal that includes UTC time information; a time calculating unit that calculates current time in the target time region based on the information stored in the regional-information storage unit and information in the standard frequency signal received by the standard-frequency receiving unit; a time display unit that displays the current time; and a display-time correcting unit that corrects at a predetermined timing the current time to be displayed in ST at the time display unit when information on a switching day to ST is included in the information in the standard frequency signal received by the standard-frequency receiving unit.

An electric device according to still another aspect of the present invention includes the above radio-controlled timepiece according to the present invention.

A time correcting method according to still another aspect of the present invention includes receiving a standard frequency signal that includes UTC time information; calculating current time of a target time region based on information relating to the target time region and information included in the standard frequency signal received; correcting, at a predetermined timing, the current time to time in DST when information on a switching day to DST is included in the standard frequency signal; and displaying the current time.

A time correcting method according to still another aspect of the present invention includes receiving a standard frequency signal that includes UTC time information; calculating current time of a target time region based on information relating to the target time region and information included in the standard frequency signal received; correcting, at a predetermined timing, the current time to time in ST when information on a switching day to ST is included in the standard frequency signal; and displaying the current time.

A computer program according to still another aspect of the present invention makes a computer perform the above time correcting method according to the present invention.

A computer-readable recording medium according to still another aspect of the present invention stores the above computer program according to the present invention.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 2 is a table of countries and their time differences from UTC;

FIG. 3 is a table for explaining the relationship between UTC and ST in each time region in the United States;

FIG. 4 is a table for explaining the relationship between UTC and DST in each time region in the United States;

DETAILED DESCRIPTION

Exemplary embodiments of a radio-controlled timepiece, an electronic device, a time correcting method, and a computer product for correcting the time according to the present invention are explained in detail with reference to accompanying drawings.

Figure 1:
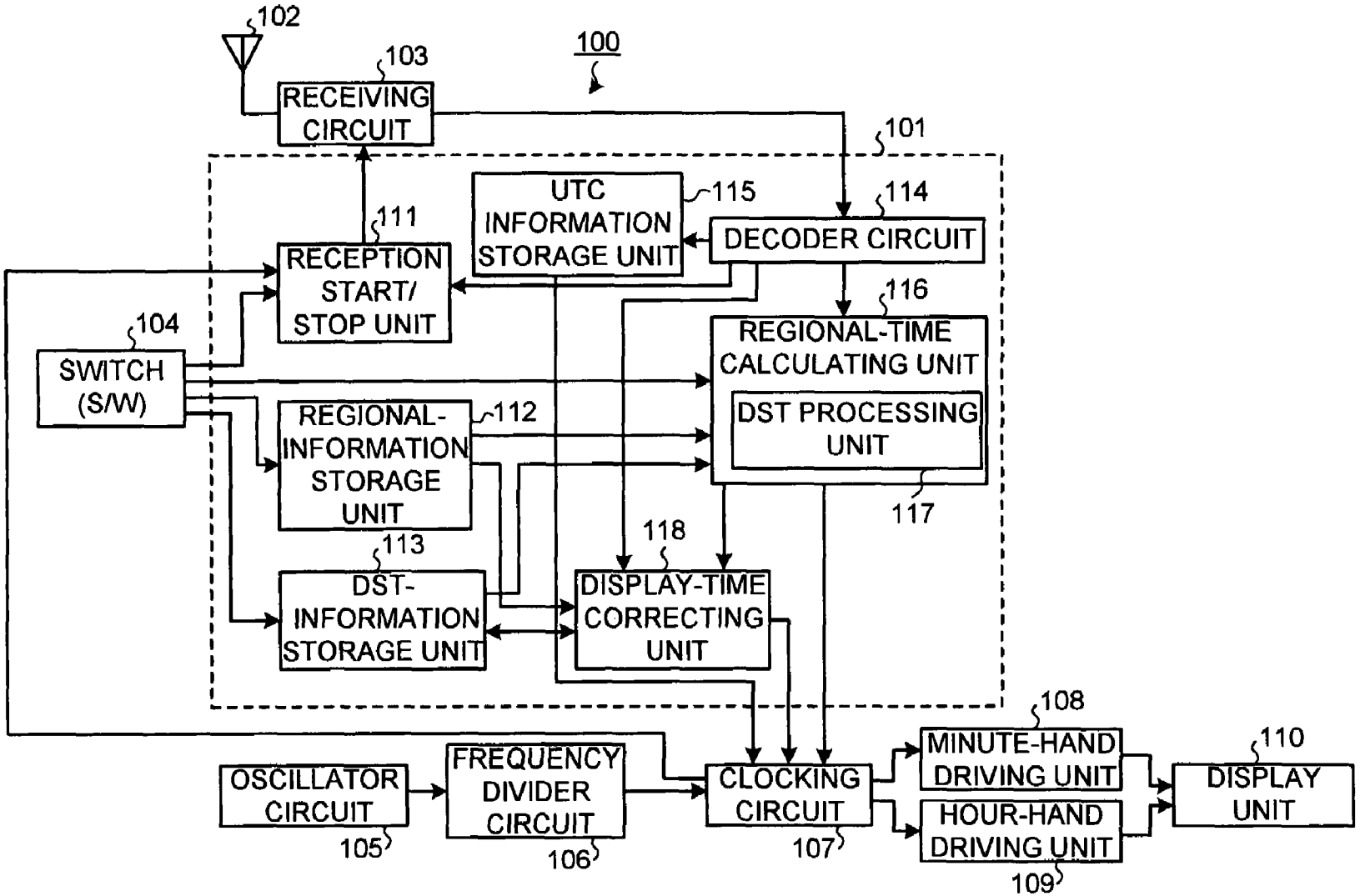
FIG. 1 is a block diagram of a radio-controlled timepiece according to an embodiment of the present invention.

FIG. 1 is a block diagram of a radio-controlled timepiece 100 according to an embodiment of the present invention. The radio-controlled timepiece 100 includes a microcomputer 101, an antenna 102, a receiving circuit 103, a switch (S/W) 104, an oscillator circuit 105, a frequency divider circuit 106, a clocking circuit 107, a minute-hand driving unit 108, an hour-hand driving unit 109, and a display unit 110.

The microcomputer 101 includes a reception start/stop unit 111, a regional-information storage unit 112, a DST-information storage unit 113, a decoder circuit 114, a UTC-information storage unit 115, a regional-time calculating unit 116, a DST processing unit 117, and a display-time correcting unit 118. While the contents of the microcomputer 101 are explained as hardware, software programs may be used instead. In other words, computer programs that realize the functions of each of the components described above can be stored in a RAM or a ROM (not shown) and those computer programs can be executed by a processor (not shown) in the microcomputer 101 to realize the respective functions.

The antenna 102 receives the standard frequency that includes time information. The receiving circuit 103 amplifies the standard frequency to perform the demodulation by processing with a filter circuit, a rectifier circuit, and a detector circuit upon receiving a command to start reception of the standard frequency from the reception start/stop unit 111. The receiving circuit 103 is a standard-frequency receiving unit that receives the standard frequency that includes UTC information, and outputs a received signal.

The user presses the switch (S/W) 104 when he/she wishes to force the reception of the standard frequency. When user presses the switch 104, the switch 104 sends a command to start the reception to the reception start/stop unit 111. The switch (which is, for example, a crown) 104 can also be used to change the regional information that is stored in the regional-information storage unit 112.

The reception start/stop unit 111 controls the receiving circuit 103 to start the reception at a time determined by the clocking circuit 107 or when the command to start the reception is received from the switch 104. Moreover, the reception start/stop unit 111 controls the receiving circuit 103 to stop the reception at a time determined by the clocking circuit 107 or when a command to stop the reception is received from the decoder circuit 114 or from the switch 104.

The decoder circuit 114 receives discrimination data (received data) in every bit that is present in the received signal output from the receiving circuit 103 and decodes the discrimination data. Upon completion of the decoding, the decoder circuit 114 outputs a reception termination signal to the reception start/stop unit 111 so that the reception start/stop unit 111 controls the receiving circuit 103 to stop the reception.

The display unit 110 displays calendar information and information about receiving conditions of the standard frequency. The calendar information is calculated by the regional-time calculating unit 116 and it includes, for example, current time, date, and day of the week. How the display unit 110 displays the current time is explained in detail later with reference to FIGS. 13 and 16.

The regional-information storage unit 112 stores regional information that is information about a target time region. The regional information includes information of four time regions in the United States, and information about areas in which DST is not implemented. For example, DST is not implemented in some part of Arizona state and Indiana state. When a person who is carrying the radio-controlled timepiece 100 moves from one time region to another time region, he/she changes the regional information by operating the switch 104.

The DST-information storage unit 113 stores information relating to DST. The information includes whether the time that is displayed by the display unit 110 is in DST or ST, at what time (hereinafter, "DST-ST switching time") to switch from DST to ST, and at what time (hereinafter, "ST-DST switching time") to switch from ST to DST.

To explain in detail, in all the time regions in the United States both the ST-DST switching time and the DST-ST switching time is A.M. 2:00:00. Therefore, the time calculated by the regional-time calculating unit 116 is A.M. 1:00:00.

The UTC-information storage unit 115 stores UTC, which is obtained by decoding the received signal by the decoder circuit 114. When a request to display UTC, instead of ST is received, the UTC-information storage unit 115 transmits UTC stored to the clocking circuit 107.

The regional-time calculating unit 116 calculates the current time in the target time region based on the regional information stored in the regional-information storage unit 112 and the signal output from the decoder circuit 114. Specifically, the regional time is calculated by adding the time difference (FIG. 2) of the target time region to UTC.

The DST processing unit 117 calculates the time in DST by adding one hour to the current time when information indicating switching to DST (Z1=1, Z2=1) is included in the received signal.

When the received signal includes the information relating to the day on which switching to DST (Z1=1, Z2=1) is to be performed, the display-time correcting unit 118 modifies the time in predetermined timing based on the current time, which is calculated by the regional-time calculating unit 116, and the information that is stored in the DST-information storage unit 113. Thus, the time is displayed in the display unit 110 in DST.

When the received signal includes the information relating to the day on which switching to ST (Z1=0, Z2=0) is to be performed, the display-time correcting unit 118 changes, at pre-set timing, the time to be displayed based on the current time and the information that is stored in the DST-information storage unit 113 such that the ST is displayed on the display unit 110.

FIG. 2 is for explaining the time differences from UTC in various time regions in the United States. The time difference of NY region (first region) is −5 hours, in CHI region (second region) is −6 hours, in COL region (third region) is −7 hours, and in LOS region (fourth region) is −8 hours.

ST in each of the regions corresponding to UTC is shown in FIG. 3. When UTC is 0:00, the ST in NY region is 19:00, in CHI region is 18:00, in COL region is 17:00, and in LOS region is 16:00 on the previous day.

As shown in FIG. 3, the local standard time in each of the regions can be calculated based on the time differences and UTC. For example, if UTC is 12 O'clock, the local time in NY region (first region) shall be 12 (local standard time)−5 (time difference)=7 O'clock. The local times shown in the cells that are shaded in FIG. 3 are the times on the previous day in comparison with the local time. For example, assume that an instruction for switching of time from ST to DST is received signal at 0 O'clock UTC. In this case, at 0 O'clock UTC it is still the previous day in all the time regions in the United States, i.e., it is not yet the "switching day". Therefore, if the switching of time is performed it will give erroneous results.

DST in each of the regions corresponding to UTC are shown in FIG. 4. DST can be obtained by adding one hour to the ST in a particular region.

Figure 5:
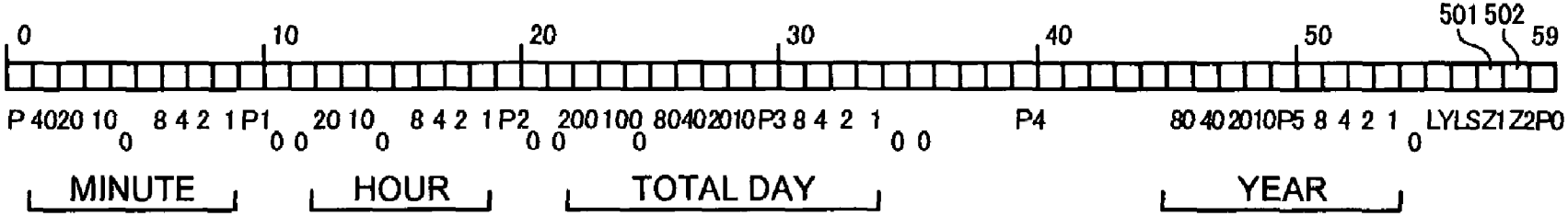
FIG. 5 illustrates a format of the data transmitted (transmitted data) in the standard frequency (WWVB time code) in the United States.
Figure 6:
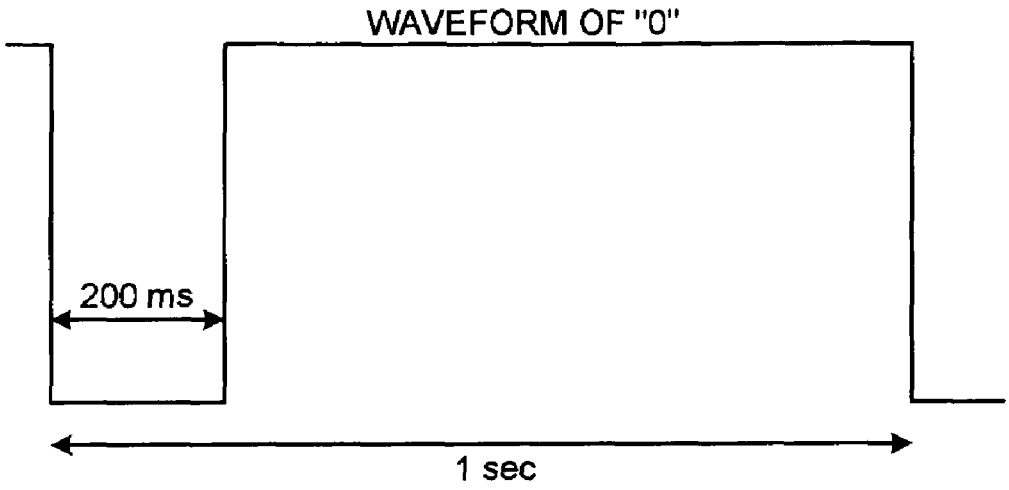
FIG. 6 is a waveform of "0"
Figure 7:
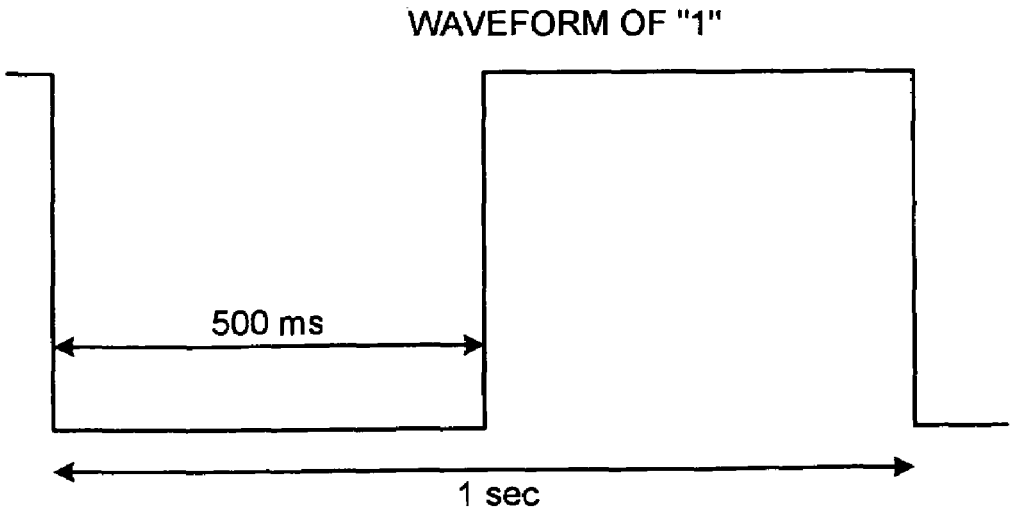
FIG. 7 is a waveform of "1"
Figures 8, 9:
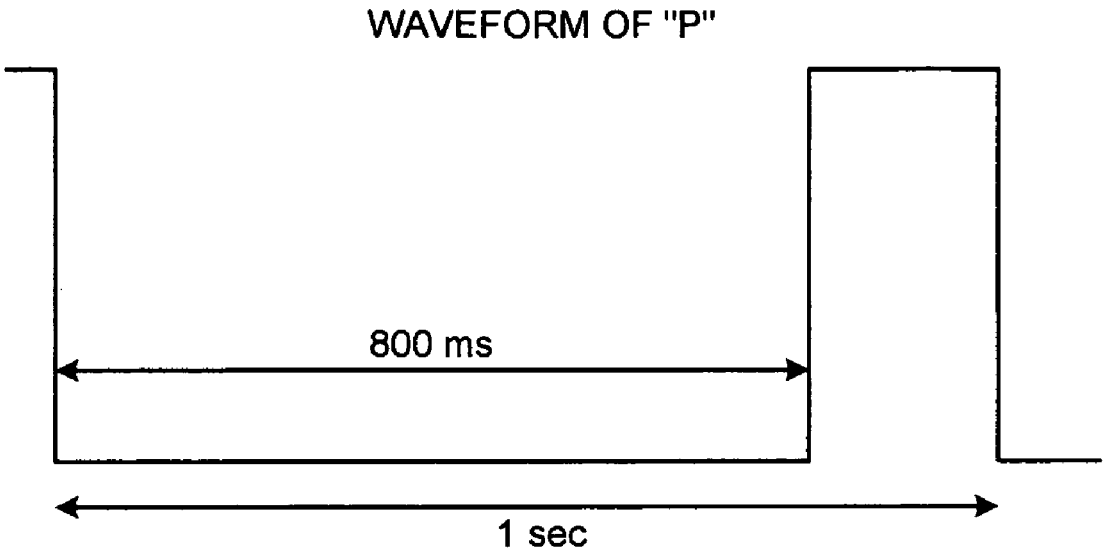
FIG. 8 is a waveform of "P"
FIG. 9 is for explaining meanings of the combination of the parameters in the transmitted data.

FIG. 5 is a format of the data transmitted on the standard frequency in the United States. FIG. 6 is a waveform of "0", FIG. 7 is a waveform of "1", and FIG. 8 is a waveform of "P" that are includes in the transmitted data. Data is transmitted by transmitting the appropriate waveforms.

As shown in FIG. 5, the transmitted data includes time data that is transmitted at a rate of one bit per second and each frame is one minute. Each frame includes information about "minute", "hour", "days" elapsed from January 1, and "year". The "year" includes only last two digits of the current year. At present whether DST is in effect or ST is in effect can be determined from parameter Z1 and Z2. The parameter Z1 (501) appears at 57th second and the parameter Z2 (502) appears at 58th second in each frame.

The transmitted data includes marker codes such as "0", "1", and "P". The waveforms of these codes are shown in FIGS. 6 to 8. The "P" code is included at several places in one frame. For example, the "P" code appears at 0th second (P), 9th second (P1), 19th second (P2), 29th second (P3), 39th second (P4), 49th second (P5), and 59th second (P0). Thus, "P" codes appear in a row at the 59th second of one frame and the 0th second of the subsequent frame. When two consecutive "P" codes are received it means that it is the start of a new frame (0th second position) and that complete and correct data can be received there after. Therefore, real data reception is started only after the 0th second position. The time data such as minute and hour are included in the frame in positions determined based on the 0th second position. Therefore, it is necessary to detect the 0th second position first to obtain the time data. Then, the waveform of the data that is transmitted every second is detected and determined to which waveform of the three waveforms shown in FIGS. 6 to 8 the data corresponds.

FIG. 9 is for explaining the meanings of the combinations of the parameters Z1 and Z2. The parameters Z1 and Z2 can have a value of either 0 or 1. For example, if both Z1 and Z2 are 0, it means that DST is in effect. When both Z1 and Z2 are 1, it means that ST is in effect. When Z1 is 1 and Z2 is 0, it means that it is the DST-ST switching day. When Z1 is 0 and Z2 is 1, it means that it is the ST-DST switching day. In the United States, the switching of time from ST to DST is performed on the first Sunday of April and the switching of time from DST to ST is performed on the last Sunday of October of every year. In other words, Z1 will be 0 and Z2 will be 1 on the first Sunday of April, and Z1 will be 1 and Z2 will be 0 on the last Sunday of October of every year.

Figure 10:
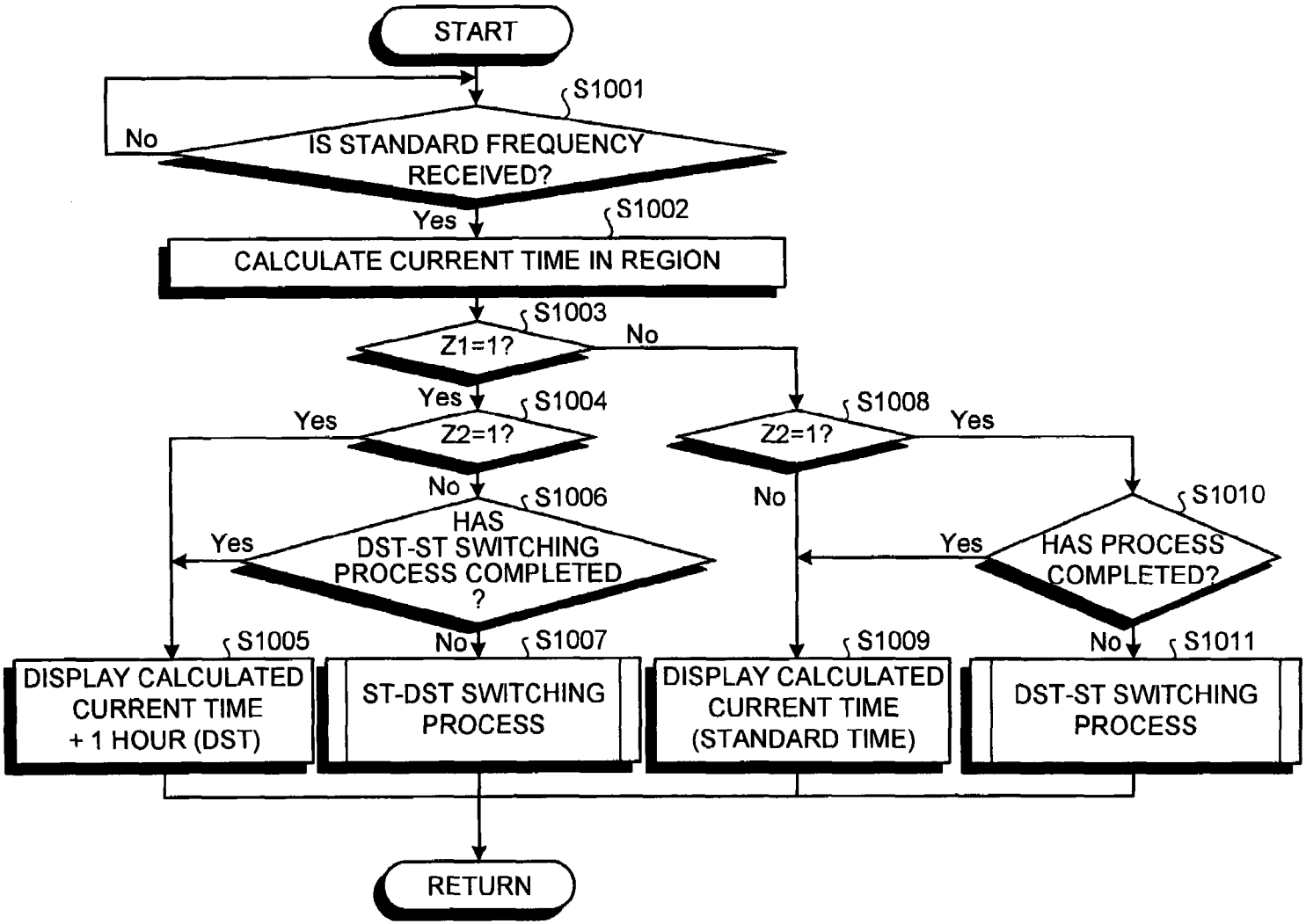
FIG. 10 is a flowchart of a process procedure for performed time-switching by the radio-controlled timepiece shown in FIG. 1.

A process procedure for switching the time will now be explained in detail. FIG. 10 is a flowchart of a DST process performed by the radio-controlled timepiece 100. First, whether the standard frequency is received is determined (step S1001). When the standard frequency is received (step S1001: Yes), the current time in the target time region is calculated from the data in received standard frequency (step S1002).

Subsequently, the parameter Z1 in the received signal is identified and, if Z1=1 (step S1003: Yes), then the data included in the parameter Z2 is identified and, if Z2=1 (step 1004: Yes), it means that DST is to be displayed (see FIG. 9). Therefore, the DST processing unit 117 adds one hour to the current time calculated in step S1002, and transmits the obtained time to the clocking circuit 107. The clocking circuit 107 clocks from the obtained time, and the display unit 110 displays the time clocked by the clocking circuit 107 (step S1005).

On the other hand, if Z2=0 (step S1004: No) it means that it is the ST-DST switching day. Therefore, a process procedure for switching from ST to DST (hereinafter, "ST-DST switching process") is performed (step S1007). However, before starting the ST-DST switching process, it is checked whether a process procedure for switching from DST to ST (hereinafter, "DST-ST switching process") has already been performed (step S1006). If the DST-ST switching process has already been performed (step S1006: Yes), then the process at step 1005 is carried out, i.e., the ST-DST switching process is not performed. The ST-DST switching process is explained in detail later using FIG. 11.

If Z1=0 (step S1003: No) and Z2=0 (step 1008: No), it means that ST is to be displayed. Therefore, the clocking circuit 107 clocks from the current time calculated in step S1002 as it is and the display unit 110 displays the time clocked by the clocking circuit 107 (step S1009).

On the other hand, if Z2=1 (step S1008: Yes), it means that it is the DST-ST switching day. Therefore, the DST-ST switching process is performed (step S1011). However, before starting the DST-ST switching process, it is checked whether the ST-DST switching process has already been performed (step S1010). If the ST-DST switching process has already been performed (step S1010: Yes), then the process in step 1009 is carried out, i.e., DST-ST switching process is not performed. The DST-ST switching process is explained in detail later using in FIG. 14.

Figure 11:
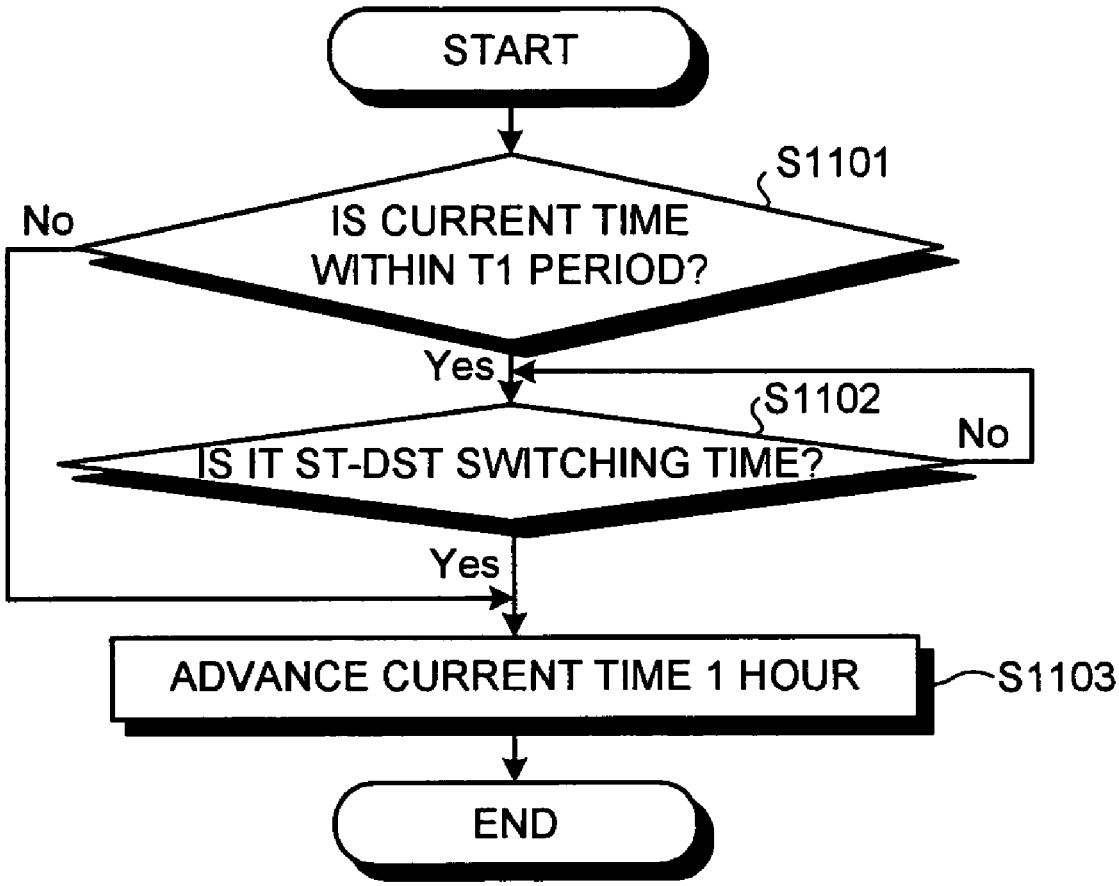
FIG. 11 is a flowchart of a ST-DST switching process.
Figure 12:
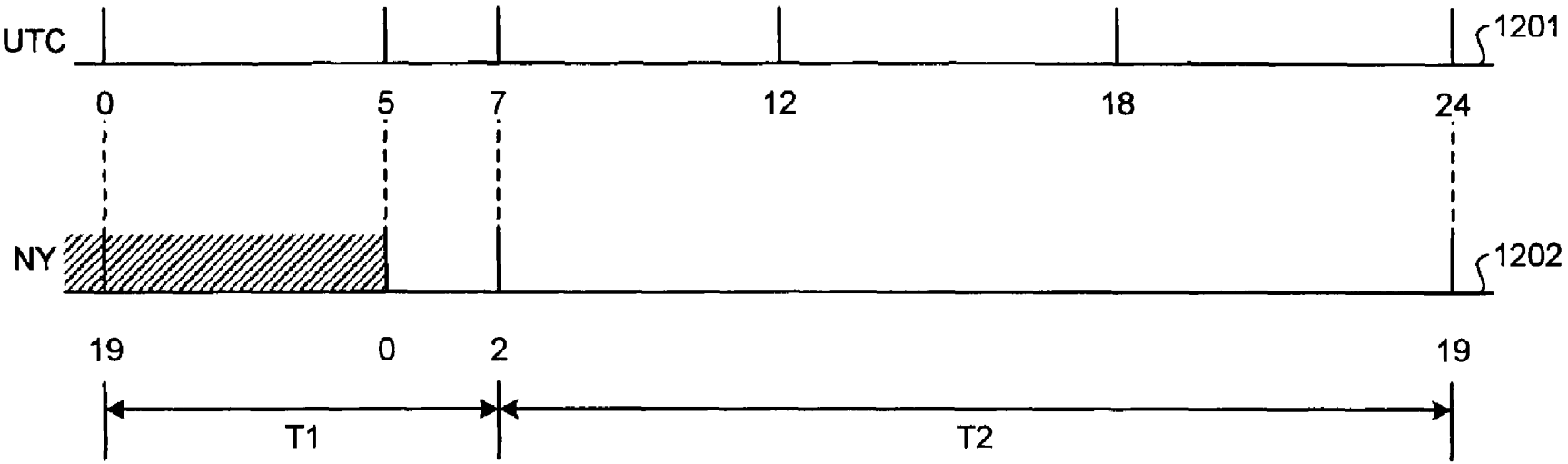
FIG. 12 is a time chart for explaining the ST-DST switching process.

The ST-DST switching process is now explained in detail using FIGS. 11 and 12. FIG. 11 is a flowchart and FIG. 12 is time chart of the ST-DST switching process. It is assumed that the person who is carrying the radio-controlled timepiece 100 is in the NY region.

As shown in FIG. 11, it is determined whether the current time calculated in step S1002 in FIG. 10 is within T1 period (see FIG. 12) (step S1101). The T1 period starts from 19 O'clock (i.e., UTC 0 O'clock) and ends at 2 O'clock (ST-DST switching time). In FIG. 12, reference numeral 1201 represents UTC and reference numeral 1202 represents ST.

If the current time is within the T1 period (step S1101: Yes), it is determined whether that current time is the ST-DST switching time, i.e., 2 O'clock, (step S1102). When it is the ST-DST switching time (step S1102: Yes), the current time is advanced 1 hour (step S1103), and the process is terminated. The display unit 110 displays the advanced current time.

On the other hand, if it is determined at step S1101 that the current time is not within the T1 period but it is within a T2 period (see FIG. 12) (step S1101: No), the current time is advanced 1 hour (step S1103) without checking whether it is the ST-DST switching time, and the process is terminated. The display unit 110 displays the advanced current time.

Figure 13:
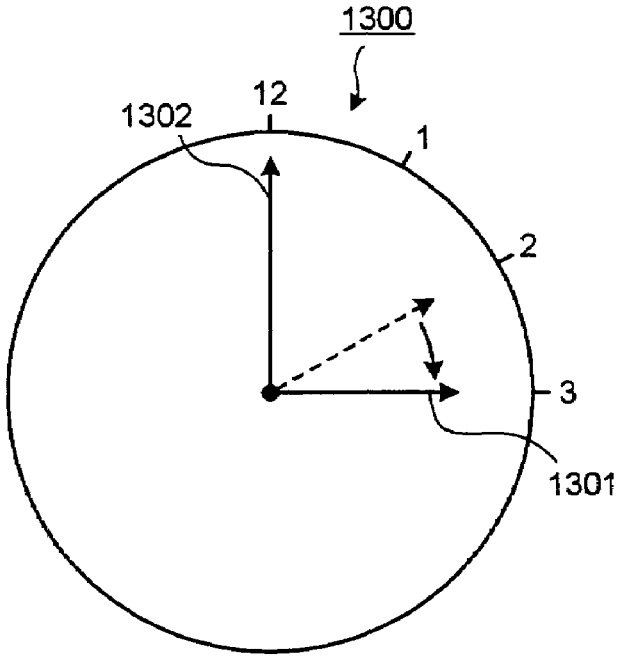
FIG. 13 is an example of display contents of the radio-controlled timepiece.

FIG. 13 is an example of how the time is displayed by the radio-controlled timepiece. It is assumed that the timepiece is analog timepiece but it can be digital timepiece. If the calculated time corresponds to the T1 period, when it becomes 2 O'clock, in other words, when an hour hand 1301 points at "2", and a minute hand 1302 points at "12" on a display board 1300, only the hour hand 1301 moves from "2" to "3" without the minute hand making a clockwise rotation. This enables an instant switch from ST to DST even for the analog timepiece.

Figure 14:
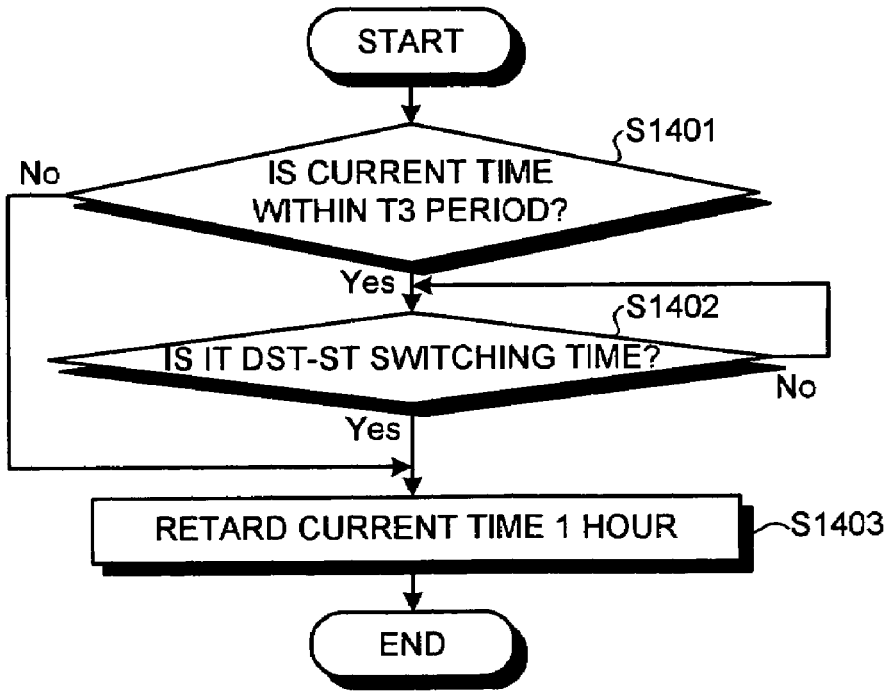
FIG. 14 is a flowchart of a DST-ST switching process.
Figure 15:
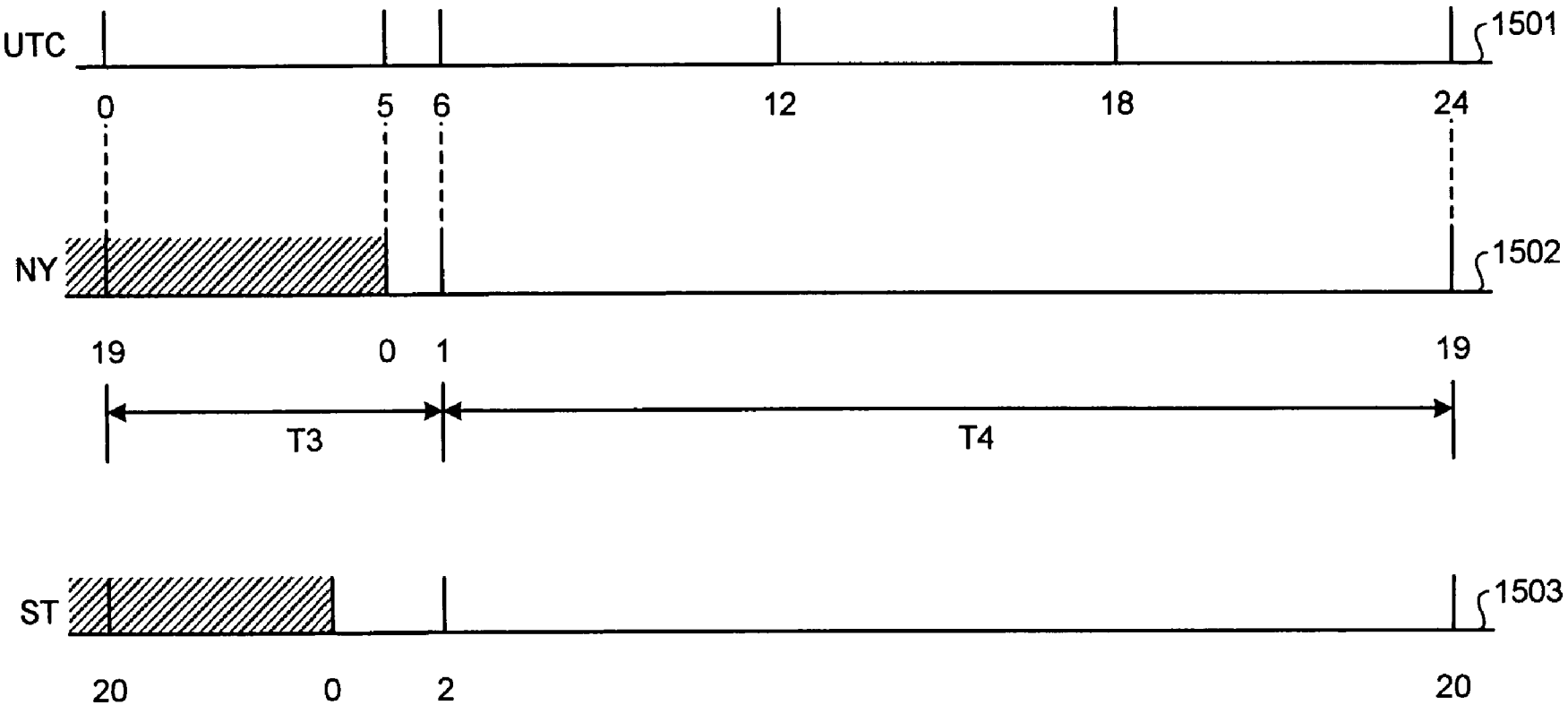
FIG. 15 is a time chart for explaining the DST-ST switching process.

The DST-ST switching process is now explained in detail using FIGS. 14 and 15. FIG. 14 is a flowchart and FIG. 15 is time chart of the DST-ST switching process. It is assumed that the person who is carrying the radio-controlled timepiece 100 is in the NY region.

As shown in FIG. 14, it is determined whether the current time calculated at step S1002 in FIG. 10 is within T3 period (see FIG. 15). The T3 period starts from 19 O'clock (i.e., UTC 0 O'clock or ST 20 O'clock) and ends at 1 O'clock (ST-DST switching time or ST 2 O'clock). In FIG. 15, reference numeral 1501 represents UTC, reference numeral 1502 represents DST, and reference numeral 1503 represents ST.

If the current time is within the T3 period (step S1401: Yes), it is determined whether the current time is the DST-ST switching time, i.e., 1 O'clock, (step S1402). When it is the DST-ST switching time (step S1402: Yes), the current time is retarded 1 hour (step S1403) and the process is terminated. The display unit 110 displays the retarded current time.

On the other hand, if it is determined at step S1401 that the current time is not within the T3 period but it is within T4 period (see FIG. 15) (step S1401: No), the current time is retarded 1 hour (step S1403) without checking whether it is the DST-ST switching time, and the process is terminated. The display unit 110 displays the retarded current time.

Figure 16:
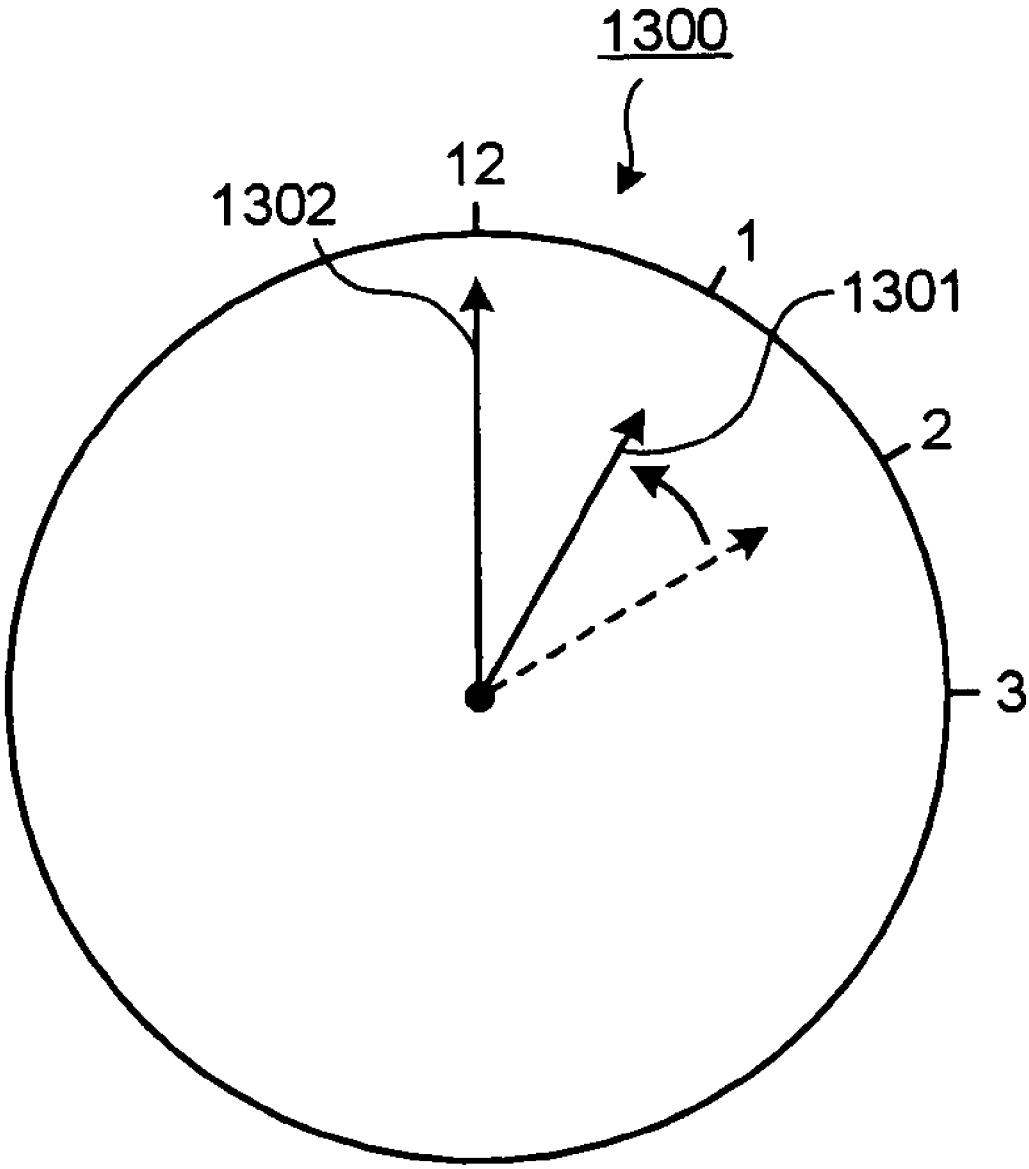
FIG. 16 is an explanatory diagram of another example of display contents of the radio-controlled timepiece.

FIG. 16 is an example of how the time is displayed by the radio-controlled timepiece. It is assumed that the timepiece is analog timepiece but it can be digital timepiece. If the calculated time corresponds to the T1 period, when it becomes 2 O'clock, in other words, when an hour hand 1301 points at "2", and a minute hand 1302 points at "12", only the hour hand 1301 moves from "2" to "1" without the minute hand making a counterclockwise rotation. This enables an instant switch from DST to ST even for the analog timepiece.

Thus, according to the radio-controlled timepiece 100, it is possible to switch the time from DST to ST or vice versa correctly, and regardless of the time region in the United States, based on only the standard frequency. In addition, it is not necessary to consider timing to receive the standard frequency. This is because if the standard frequency is received after the predetermined time but before the switching time, the switching process is not performed until the switching time, and if the standard frequency is received after the switching time, the switching process is soon performed. Thus, the DST switching process based on the standard frequency is efficiently achieved.

Moreover, it is also possible to easily change the DST switching time just by inputting modified information on the regional information.

The radio-controlled timepiece can be any timepiece such as a wrist watch, a wall clock, and a table clock. Furthermore, the present invention is not to be limited to the radio-controlled timepiece, and may be applied to portable information terminals such as mobile phones, PDAs (Personal Digital Assistants), and laptop computers, or other electronic devices including household electrical appliances and automobiles.

As described above, according to the present invention, it is possible to obtain a radio-controlled timepiece that performs the DST switching process at an accurate timing, an electronic device that includes the radio-controlled timepiece, a time correcting method, and a computer product for correcting time.

The present document incorporates by reference the entire contents of Japanese priority document, 2003-163645 filed in Japan on Jun. 9, 2003.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A radio-controlled timepiece comprising:

a regional-information storage unit that stores information relating to a target time region;

a standard-frequency receiving unit that receives a standard frequency signal that includes Coordinated Universal Time (UTC) information;

a time calculating unit that calculates current time in the target time region based on the information stored in the regional-information storage unit and information in the standard frequency signal received by the standard-frequency receiving unit;

a time display unit that displays the current time; and a display-time correcting unit that corrects at a predetermined timing the current time to be displayed in Daylight Saving Time (DST) at the time display unit when information on a switching day to DST is included in the information in the standard frequency signal received by the standard-frequency receiving unit, wherein the predetermined timing is determined based on the current time calculated by the time calculating unit.

2. The radio-controlled timepiece according to claim 1, wherein if the current time calculated is after a time corresponding to 0 O'clock in UTC time, and before a switching time to DST that is registered in advance, the display-time correcting unit does not correct the current time until the switching time to DST comes.

3. The radio-controlled timepiece according to claim 2, wherein the switching time to DST is A.M. 2:00:00 in standard time.

4. The radio-controlled timepiece according to claim 1, wherein if the current time calculated is after a switching time to DST, and before a time corresponding to 0 O'clock in UTC time, the display-time correcting unit corrects the current time that has been displayed by adding one hour thereto.

5. The radio-controlled timepiece according to claim 4, wherein the switching time to DST is A.M. 2:00:00 in standard time.

6. The radio-controlled timepiece according to claim 1, wherein the switching day to DST is the first Sunday of April.

7. The radio-controlled timepiece according to claim 1, wherein the time display unit includes a minute hand;

an hour hand; and an hour-hand driving unit that drives the hour hand independently from the minute hand, and the hour-hand driving unit drives to set the hour hand forward one hour when the display time is corrected by adding one hour by the display-time correcting unit.

8. The radio-controlled timepiece according to claim 1, further comprising a regional-information input unit to input the information relating to the target time region, wherein the regional-information storage unit stores the information input by the regional-information input unit.

9. The radio-controlled timepiece according to claim 1, further comprising:

an antenna communicatively connected to the standard-frequency receiving unit, the antenna being configured to receive the standard frequency signal as a signal propagating over the air.

10. A radio-controlled timepiece comprising:

a regional-information storage unit that stores information relating to a target time region;

a standard-frequency receiving unit that receives a standard frequency signal that includes Coordinated Universal Time (UTC) time information;

a time calculating unit that calculates current time in the target time region based on the information stored in the regional-information storage unit and information in the standard frequency signal received by the standard-frequency receiving unit;

a time display unit that displays the current time; and a display-time correcting unit that corrects at a predetermined timing the current time to be displayed in standard time at the time display unit when information on a switching day to standard time is included in the information in the standard frequency signal received by the standard-frequency receiving unit, wherein the predetermined timing is determined based on the current time calculated by the time calculating unit.

11. The radio-controlled timepiece according to claim 10, wherein if the current time calculated is after a time corresponding to 0 O'clock in UTC time, and before a switching time to standard time that is registered in advance, the display-time correcting unit does not correct the current time until the switching time to standard time comes.

12. The radio-controlled timepiece according to claim 11, wherein the switching time to standard time is A.M. 2:00:00 in DST.

13. The radio-controlled timepiece according to claim 10, wherein if the current time calculated is after a switching time to standard time, and before a time corresponding to 0 O'clock in UTC time, the display-time correcting unit corrects the current time that has been displayed by subtracting one hour therefrom.

14. The radio-controlled timepiece according to claim 13, wherein the switching time to standard time is A.M. 2:00:00 in DST.

15. The radio-controlled timepiece according to claim 10, wherein the switching day to standard time is the last Sunday of October.

16. The radio-controlled timepiece according to claim 10, wherein the time display unit includes a minute hand;

an hour hand; and an hour-hand driving unit that drives the hour hand independently from the minute hand, and the hour-hand driving unit drives to set the hour hand back one hour when the display time is corrected by subtracting one hour by the display-time correcting unit.

17. The radio-controlled timepiece according to claim 10, further comprising a regional-information input unit to input the information relating to the target time region, wherein the regional-information storage unit stores the information input by the regional-information input unit.

18. The radio-controlled timepiece according to claim 10, further comprising:

an antenna communicatively connected to the standard-frequency receiving unit, the antenna being configured to receive the standard frequency signal as a signal propagating over the air.

19. An electric device with a radio-controlled timepiece comprising a regional-information storage unit that stores information relating to a target time region;

a standard-frequency receiving unit that receives a standard frequency signal that includes Coordinated Universal Time (UTC) information;

a time calculating unit that calculates current time in the target time region based on the information stored in the regional-information storage unit and information in the standard frequency signal received by the standard-frequency receiving unit;

a time display unit that displays the current time; and a display-time correcting unit that corrects at a predetermined timing the current time to be displayed in Daylight Saving Time (DST) at the time display unit when information on a switching day to DST is included in the information in the standard frequency signal received by the standard-frequency receiving unit, wherein the predetermined timing is determined based on the current time calculated by the time calculating unit.

20. The electric device according to claim 19, further comprising:

an antenna communicatively connected to the standard-frequency receiving unit, the antenna being configured to receive the standard frequency signal as a signal propagating over the air.

21. An electric device with a radio-controlled timepiece comprising a regional-information storage unit that stores information relating to a target time region;

a standard-frequency receiving unit that receives a standard frequency signal that includes Coordinated Universal Time (UTC) time information;

a time calculating unit that calculates current time in the target time region based on the information stored in the regional-information storage unit and information in the standard frequency signal received by the standard-frequency receiving unit;

a time display unit that displays the current time; and a display-time correcting unit that corrects at a predetermined timing the current time to be displayed in standard time at the time display unit when information on a switching day to standard time is included in the information in the standard frequency signal received by the standard-frequency receiving unit, wherein the predetermined timing is determined based on the current time calculated by the time calculating unit.

22. The radio-controlled timepiece according to claim 21, further comprising:

an antenna communicatively connected to the standard-frequency receiving unit, the antenna being configured to receive the standard frequency signal as a signal propagating over the air.

23. A time correcting method comprising:

receiving a standard frequency signal that includes Coordinated Universal Time (UTC) time information;

calculating current time of a target time region based on information relating to the target time region and information included in the standard frequency signal received;

correcting, at a predetermined timing, the current time to time in Daylight Saving Time (DST) when information on a switching day to DST is included in the standard frequency signal; and displaying the current time, wherein the predetermined timing is determined based on the current time calculated by the calculating step.

24. The time correcting method according to claim 23, wherein the receiving step comprises receiving, by an antenna communicatively connected to a standard-frequency receiving unit, the standard frequency signal, as a signal propagating over the air.

25. A time correcting method comprising:

receiving a standard frequency signal that includes Coordinated Universal Time (UTC) time information;

calculating current time of a target time region based on information relating to the target time region and information included in the standard frequency signal received;

correcting, at a predetermined timing, the current time to time in standard time when information on a switching day to standard time is included in the standard frequency signal; and displaying the current time, wherein the predetermined timing is determined based on the current time calculated by the calculating step.

26. The time correcting method according to claim 25, wherein the receiving step comprises receiving, by an antenna communicatively connected to a standard-frequency receiving unit, the standard frequency signal, as a signal propagating over the air.

27. A computer-readable recording medium that stores a computer program which when executed on a computer makes the computer perform the steps of:

receiving a standard frequency signal that includes Coordinated Universal Time (UTC) time information;

calculating current time of a target time region based on information relating to the target time region and information included in the standard frequency signal received;

correcting, at a predetermined timing, the current time to time in Daylight Saving Time (DST) when information on a switching day to DST is included in the standard frequency signal; and displaying the current time, wherein the predetermined timing is determined based on the current time calculated by the calculating step.

28. A computer-readable recording medium that stores a computer program which when executed on a computer makes the computer perform the steps of:

receiving a standard frequency signal that includes Coordinated Universal Time (UTC) time information;

calculating current time of a target time region based on information relating to the target time region and information included in the standard frequency signal received;

correcting, at a predetermined timing, the current time to time in standard time when information on a switching day to standard time is included in the standard frequency signal; and displaying the current time, wherein the predetermined timing is determined based on the current time calculated by the calculating step.

* * * * *